US006442280B1

(12) United States Patent
Ito

(10) Patent No.: US 6,442,280 B1
(45) Date of Patent: Aug. 27, 2002

(54) APPARATUS DETECTING HOWLING BY DECAY PROFILE OF IMPULSE RESPONSE IN SOUND SYSTEM

(75) Inventor: Tsugio Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/014,886

(22) Filed: Jan. 28, 1998

(30) Foreign Application Priority Data

Jan. 28, 1997 (JP) ..... 9-014212

(51) Int. Cl.[7] ..... H04R 27/00
(52) U.S. Cl. ..... 381/83; 381/93
(58) Field of Search ..... 381/71.9, 71.11, 381/71.12, 94.7, 94.9, 83, 93, 59, 58, 66, FOR 83.93; 379/406.01–406.11, 406.16

(56) References Cited

U.S. PATENT DOCUMENTS 4,888,808 A * 12/1989 Ishikawa et al. ..... 351/103
5,442,712 A * 8/1995 Kawamura et al. ..... 381/83
5,729,614 A * 3/1998 Nagata et al. ..... 381/83

* cited by examiner

*Primary Examiner*—Duc Nguyen
*Assistant Examiner*—Lun-See Lao
(74) *Attorney, Agent, or Firm*—Pillsbury Winthrop LLP

(57) ABSTRACT

A howling canceling apparatus is provided in a sound system containing a microphone, a loudspeaker and an amplifier for canceling howling which may occur by feedback of sound from the loudspeaker to the microphone. In the howling canceling apparatus, a measuring section measures an impulse response of the sound system to determine a time length of a decay portion of the impulse response. A detecting section detects an occurrence of the howling when the determined time length is longer than a predetermined reference time length, and further analyzes a frequency spectrum of the decay portion of the impulse response to determine a frequency point at which the howling occurs. An attenuating section attenuates a frequency component of the sound around the determined frequency point so as to cancel the howling.

16 Claims, 4 Drawing Sheets x(t)
y(t)
A/D
11
12
TIME WINDOW BLOCK
13
14
FFT
15
16
X(k)
Y(k)
COMPLEX CONJUGATE BLOCK
17
18
X*(k)
Y*(k)
19
21
24
MULTI-TIME AVERAGING BLOCK
20
22
25
X*(k)X(k)
X*(k)Y(k)
Y*(k)Y(k)
23
26
27
28
SQUARING BLOCK
H(k)
29
IFFT
30
h(i)
$\gamma_{xy}^2$

APPARATUS DETECTING HOWLING BY DECAY PROFILE OF IMPULSE RESPONSE IN SOUND SYSTEM

BACKGROUND OF THE INVENTION

1. Field of the Invention

The present invention generally relates to a howling detecting apparatus for detecting a howl caused by acoustic feedback between a microphone and a loudspeaker in an acoustic system and a howling canceling apparatus based on this howling detecting apparatus.

2. Description of Related Art

In a PA (Public Address) system of a concert hall and an acoustic system such as SRS (Sound Room System) that includes a loudspeaker and a microphone, a sound outputted from the loudspeaker is fed back to the microphone. Consequently, the closed-loop gain of a particular frequency sometimes exceeds the unit value one, thereby causing a howl. To cancel the howl of this type, several techniques are known.

In the first technique, a situation prone to howl is intentionally created during a rehearsal while monitoring frequency characteristics of particular points in the acoustic system. From the monitoring result, it is determined that a howl occurs if a peak frequency continues over a certain reference time above a certain reference level. According to this determination, a filter for suppressing the level of the frequency band including the peak is configured by means of DSP (Digital Signal Processor). This technique is disclosed in "Automatic Howling Detecting and Canceling System Based on DSP" Tsuge et al., AES Tokyo Convention Preliminary Document 1995, pp. 112–155.

In the second technique, an impulse response of an acoustic system is measured, and an inverse signal component of howl caused by a voice fed back to the microphone is computed. To be specific, this inverse signal component is computed by convolution of the measured impulse response and the voice signal. The obtained inverse signal component is subtracted directly from an output signal to eliminate the howl. This technique is disclosed in Japanese Non-examined Patent Publication No. 56-30397.

However, the above-mentioned first technique requires to set the filter beforehand during the equipment installation. Besides, every time an environmental change takes place such as microphone relocation during the installation operation, the filter setting must be adjusted.

As for the second technique, the compensative component (namely, the inverse signal component) of a howl obtained from the measured impulse response is subtracted directly from the output signal, so that the impulse response must be measured with a fairly high accuracy. Otherwise, compensation error occurs, which leads to unintended distortion of the output signal. For the accurate measurement of the impulse response, an impulse waveform is generated in the monitoring mode beforehand to measure a feedback signal in the acoustic system. Still, a problem remains that the impulse response fluctuates with environmental changes. Especially, a large-scale hall for example involves a relatively long sound travel path, the transfer function frequently being fluctuated by temperature variation or partial air-flow variation. Hence, it is virtually impossible for large-scale halls to cancel howling with an inverse signal.

SUMMARY OF THE INVENTION

It is therefore an object of the present invention to provide a howling detecting apparatus capable of avoiding howling detection error and compensation error and to provide a howling canceling apparatus based on this howling detecting apparatus.

It is another object of the present invention to provide a howling detecting apparatus capable of instantly coping with environmental variations without requiring preset operations and to provide a howling canceling apparatus based on this howling detecting apparatus.

The inventive howling detecting apparatus is provided in a sound system containing a microphone, a loudspeaker and an amplifier for detecting howling which may occur by feedback of sound from the loudspeaker to the microphone. In the howling detecting apparatus, a measuring section measures an impulse response of the sound system to determine a time length of a decay portion of the impulse response. A detecting section detects an occurrence of the howling when the determined time length is longer than a predetermined reference time length.

Preferably, the detecting section analyzes a frequency spectrum of the decay portion of the impulse response to determine a frequency point at which the howling occurs.

Preferably, the measuring section measures the impulse response in situ based on an input to and an output from the amplifier which is disposed between the microphone and the loudspeaker so as to determine the time length of the decay portion of the impulse response on real time. In such a case, the measuring section measures the impulse response by time-sequentially computing a spectrum of the impulse response in terms of a ratio of a power spectrum of the input to a cross spectrum of the input and the output. Otherwise, the measuring section measures the impulse response by digitally processing the input and the output without computing spectra of the input and the output.

Preferably, the measuring section periodically measures an impulse response of the sound system at a predetermined time interval which is longer than the predetermined reference time length.

Preferably, the measuring section determines the time length of the decay portion of the impulse response in terms of a duration during which a decibel of the measured impulse response falls below a threshold decibel.

The inventive howling canceling apparatus is provided in a sound system containing a microphone, a loudspeaker and an amplifier for canceling howling which may occur by feedback of sound from the loudspeaker to the microphone. In the howling canceling apparatus, a measuring section measures an impulse response of the sound system to determine a time length of a decay portion of the impulse response. A detecting section detects an occurrence of the howling when the determined time length is longer than a predetermined reference time length, and further analyzes a frequency spectrum of the decay portion of the impulse response to determine a frequency point at which the howling occurs. An attenuating section attenuates a frequency component of the sound around the determined frequency point so as to cancel the howling.

Preferably, the measuring section measures the impulse response in situ based on an input to and an output from the amplifier which is disposed between the microphone and the loudspeaker so as to determine the time length of the decay portion of the impulse response on real time.

Preferably, the measuring section periodically measures an impulse response of the sound system at a predetermined time interval which is longer than the predetermined reference time length.

Preferably, the measuring section determines the time length of the decay portion of the impulse response in terms of a duration during which a decibel of the measured impulse response falls below a threshold decibel.

Preferably, the attenuating section comprises an equalizer connected to the amplifier for variably attenuating a frequency component of the sound in response to the determined frequency point.

In an normal state where no howl is generated, an impulse response of the sound system or acoustic system includes only responses of a hall and circuits. When a howl appears, the decay time of the impulse response gets longer, the waveform thereof changing conspicuously. At the rear portion or tail portion of the impulse response at this moment, the frequency component causing the howl is dominant. Thus, the occurrence of a howl is determined by monitoring the damping tendency of the impulse response waveform. In this case, even if the predicted accuracy of the impulse waveform itself is not so high, the occurrence of a howl can be detected with high accuracy.

According to the howling detecting apparatus of the present invention, the impulse response of an acoustic system is measured. If the time from starting this measurement to a predetermined damping level is longer than a predetermined time, namely, if the tail of the impulse response becomes relatively long, it is recognized that a howl has occurred. In this case, even if the impulse response is predicted comparatively rough, the occurrence of a howl can be recognized with high accuracy. In addition, according to this howling detecting apparatus, after detecting a howl by the above-mentioned method, a howling point is detected from the frequency component included in the waveform of the impulse response after the predetermined time. This allows correct prediction of the frequency point at which a howl is caused.

According to the howling canceling apparatus of the present invention, the frequency component of the above-mentioned howling point is suppressed in the acoustic or sound system based on the result of the howling point detection by the above-mentioned method, thereby canceling howling. As compared with the conventional method of adding an inverse signal to an output signal for compensation, this howling canceling apparatus involves less chance of causing error compensation, which less adversely affects other frequency bands, thereby implementing effective howling cancellation.

In the present invention, the occurrence of a howl is detected by monitoring the damping tendency of an impulse response waveform. From the frequency characteristic at the tail of the impulse response waveform, the howling point is obtained upon occurrence of a howl. By suppressing the frequency component around the obtained howling point, the howl is canceled. Consequently, as compared with the conventional method in which the inverse signal obtained from the impulse response is subtracted directly from the output signal, the predicted accuracy of the impulse response waveform itself need not be set so high. This allows application of a simplified technique of predicting the impulse response from the input/output signal of an acoustic system not flat in spectrum. The application of this technique eliminates the necessity for providing a special instrumentation mode, and allows real-time continuous prediction of the impulse response. Thus, the novel constitution eliminates most of the conventionally required presetting operations, and is capable of instantly coping with environmental variations.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

Figure 1:
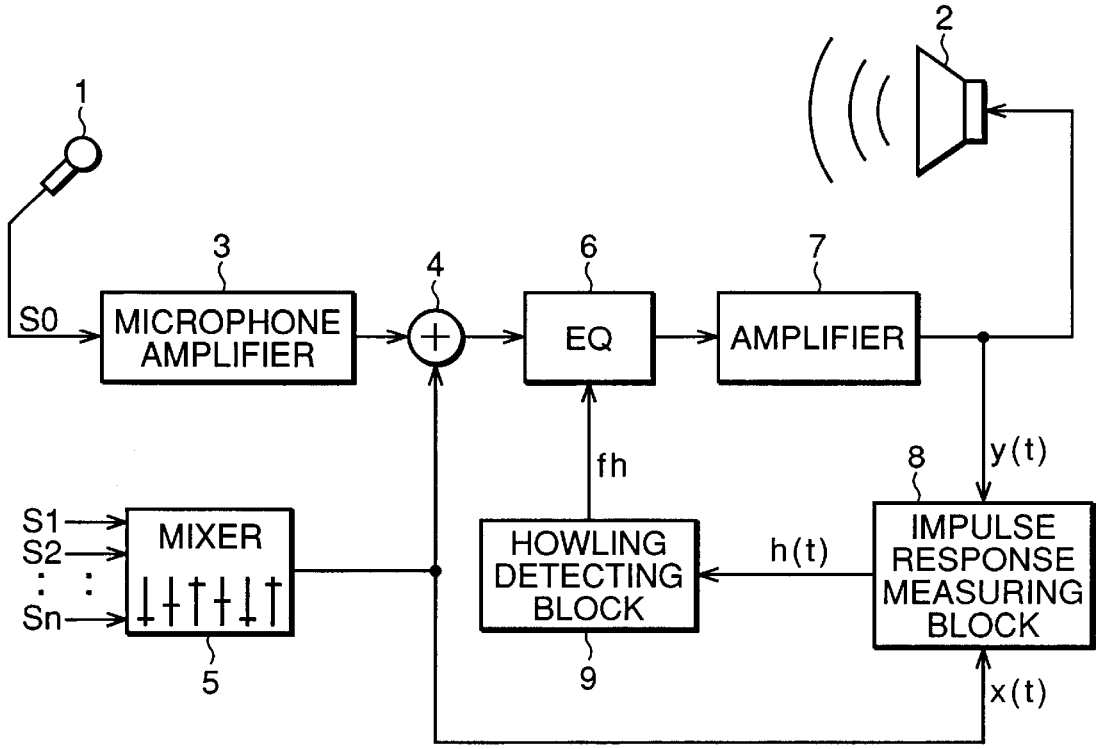
FIG. 1 is a block diagram illustrating an acoustic system practiced as one preferred embodiment of the present invention.

Now, referring to FIG. 1, there is shown a block diagram illustrating constitution of an acoustic system practiced as one preferred embodiment of the present invention. This acoustic system includes at least one microphone 1 and one loudspeaker 2. In this acoustic system, an acoustic signal outputted from the loudspeaker 2 arranged in a concert hall for example is possibly picked up by the microphone 1.

An audio signal S0 inputted from the microphone 1 is amplified by a microphone amplifier 3 and is then inputted into an adder 4. Audio signals S1, S2, . . . , Sn supplied from the line of an electronic musical instrument or an acoustic device or another microphone that does not cause a howl are mixed by a mixer 5, and are further mixed with the audio signal S0 by the adder 4. The output from the adder 4 is inputted into an amplifier 7 via an equalizer (EQ) for howling cancellation. The amplified signal is then outputted from the loudspeaker 2.

This acoustic system also has an impulse response measuring block 8. An input signal x(t) having no howling component outputted from the mixer 5 and an output signal y(t) supplied to the loudspeaker 2 are inputted in the impulse response measuring block 8. The impulse response measuring block 8 measures an impulse response h(t) real-time at a certain cycle. The impulse response h(t) obtained by the impulse response measuring block 8 is supplied to a howling detecting block 9. From the supplied impulse response h(t), the howling detecting block 9 detects as to whether a howl occurs. If the howl is found, the howling detecting block 9 further detects a howling point fh of that howl. Then, the howling detecting block 9 controls the equalizer 6 such that the frequency band around the detected howling point fh is suppressed, thereby canceling the howl.

Figure 2:
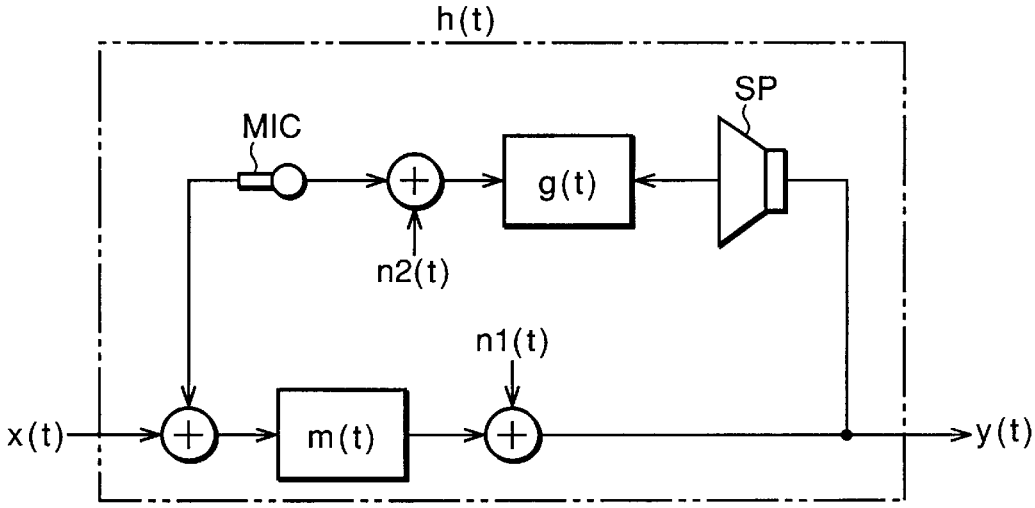
FIG. 2 is a schematic diagram illustrating a closed transfer function of the preferred embodiment shown in FIG. 1.

The following describes the operation of the acoustic system constituted as described above. Referring to FIG. 2, there is shown a schematic block diagram illustrating the impulse response h(t) of this acoustic system. In the figure, m(t) is an impulse response including the adder 4, the equalizer 6 and the amplifier 7, nl(t) is a noise that enters this system, g(t) is an impulse response of the hall between the loudspeaker 2 and the microphone 1, and n2(t) is a noise that enters the microphone 1. A closed transfer loop is formed via the m(t) and the g(t). Where no howl is taking place, the g(t) is the response of the hall alone and its magnitude is small. When a howl takes place, the g(t) grows or emerges.

Figure 3A:
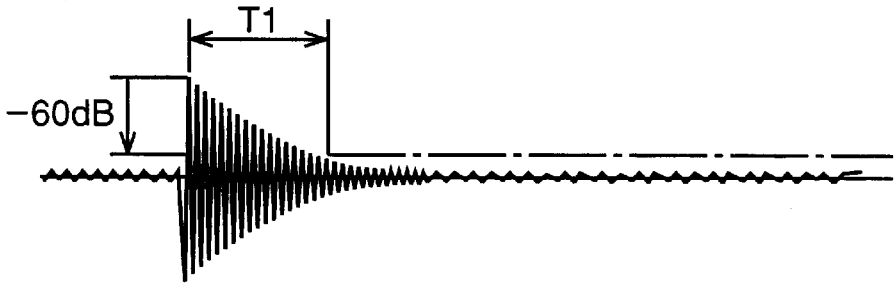
FIGS. 3(*a*), 3(*b*), and 3(*c*) are waveform diagrams illustrating impulse response waveforms in the preferred embodiment shown in FIG. 1.
Figure 3B:
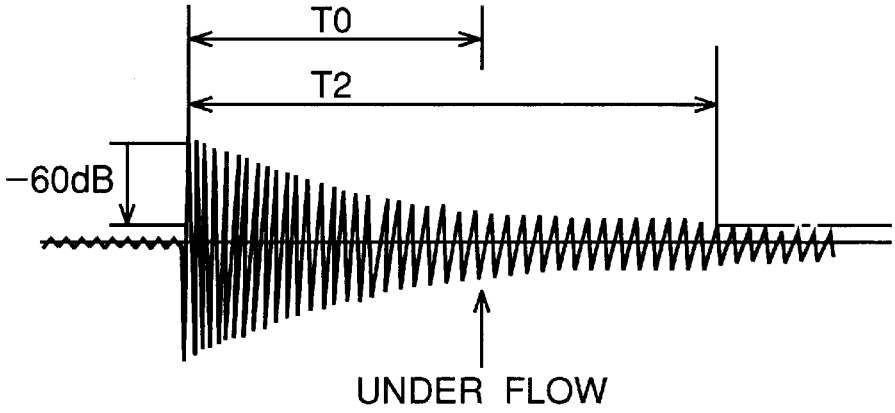
Figure 3C:
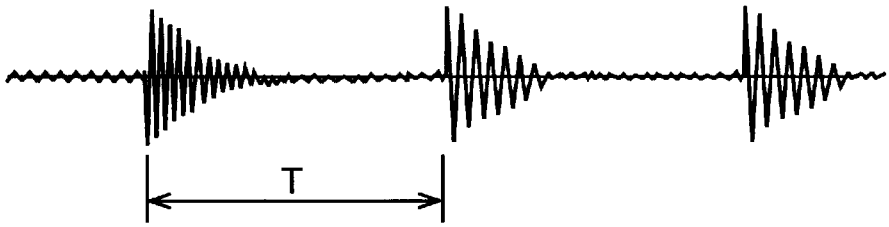

FIGS. 3(*a*), 3(*b*), and 3(*c*) illustrate waveforms of the impulse response h(t) for the understanding of a howl. FIG. 3(*a*) shows an impulse response waveform indicating that no howl is taking place. FIG. 3(*b*) shows an impulse response waveform indicating that a howl is taking place. As shown in the figure, when the howl is taking place, the impulse response h(t) does not damp for a long time as compared with the state in which no howl is taking place. Therefore, in order to check a damping tendency, the impulse response h(t) is measured by the impulse response measuring block 8.

Referring back to FIG. 1, the inventive howling canceling apparatus is provided in the sound system containing the microphone 1, the loudspeaker 2 and the amplifier 7 for canceling howling which may occur by feedback of sound from the loudspeaker 2 to the microphone 1. In the howling canceling apparatus, the measuring section 8 measures an impulse response h(t) of the sound system to determine a time length T1 or T2 of a decay portion of the impulse response h(t). The detecting section 9 detects an occurrence of the howling when the determined time length T2 is longer than a predetermined reference time length T0, and further analyzes a frequency spectrum of the decay portion of the impulse response h(t) to determine a frequency point fh at which the howling occurs. An attenuating section including EQ 6 attenuates a frequency component of the sound around the determined frequency point fh so as to cancel the howling.

Preferably, the measuring section 8 measures the impulse response h(t) in situ based on the input signal x(t) to the amplifier 7 and the output signal y(t) from the amplifier 7 which is disposed between the microphone 1 and the loudspeaker 2 so as to determine the time length T1 or T2 of the decay portion of the impulse response h(t) on real time. Preferably, the measuring section 8 periodically measures an impulse response h(t) of the sound system at a predetermined time interval T which is longer than the predetermined reference time length T0. Preferably, the measuring section 8 determines the time length T1 or T2 of the decay portion of the impulse response h(t) in terms of a duration during which a decibel of the measured impulse response falls below a threshold decibel by −60 dB, for example. Preferably, the attenuating section comprises the equalizer 6 connected to the amplifier 7 for variably attenuating a frequency component of the sound in response to the determined frequency point fh.

Let discrete series of the input signal x(t) and the output signal y(t) be x(n) and y(n), respectively, and discrete series of the impulse response h(t) be h(i), then the output signal series y(n) is expressed by equation (1) below by convolution of the input signal series x(n) and the impulse response h(i):

$$y(n) = \sum_{i=0}^{N} x(n-i)h(i) \tag{1}$$

In handling the input signal x(n) having no flat spectrum, it is known that the impulse response h(i) can be obtained by the ratio of power spectrum to cross spectrum. This is referred to as a cross-spectrum method. To be more specific, let the spectrum of the input series x(n) and its complex conjugate spectrum be X(k) and X*(k), respectively, and the spectrum of the output series y(n) and its complex conjugate spectrum be Y(k) and Y*(k), respectively, then spectrum H(k) of the impulse response h(i) is expressed by equation (2) below:

$$H(k) = \frac{\overline{X^*(k)X(k)}}{\overline{X^*(k)Y(k)}} \tag{2}$$

where, X*(k)X(k) is power spectrum and X*(k)Y(k) is cross spectrum. In equation (2), the upper bars denote multi-time averages of the power spectrum and the cross spectrum.

When a music source is used, a portion having a low spectrum level of this source is susceptible to effects such as a noise. If such an effect appears, a so-called burst appears conspicuously on the transfer function. Consequently, the noise affects the impulse response. To circumvent this problem, a coherence function may be used. Coherence $\gamma xy^2$ is obtained from equation (3) below:

$$\gamma_{XY}{}^2 = \frac{|\overline{X^*(k)Y(k)}|^2}{\{\overline{X^*(k)X(k)}\}\cdot\{\overline{Y^*(k)Y(k)}\}} \tag{3}$$

If the effect of noise is high, the coherence $\gamma xy^2$ goes below the unit value one. Multiplying the obtained transfer function H(k) by the coherence $\gamma xy^2$ reduces the effect of noise in impulse response prediction. The impulse response thus obtained is approximate to the true impulse response but sufficient for use for howling detection. This method is desirable because detection accuracy increases by reduction of the effect of noise.

Figure 4:
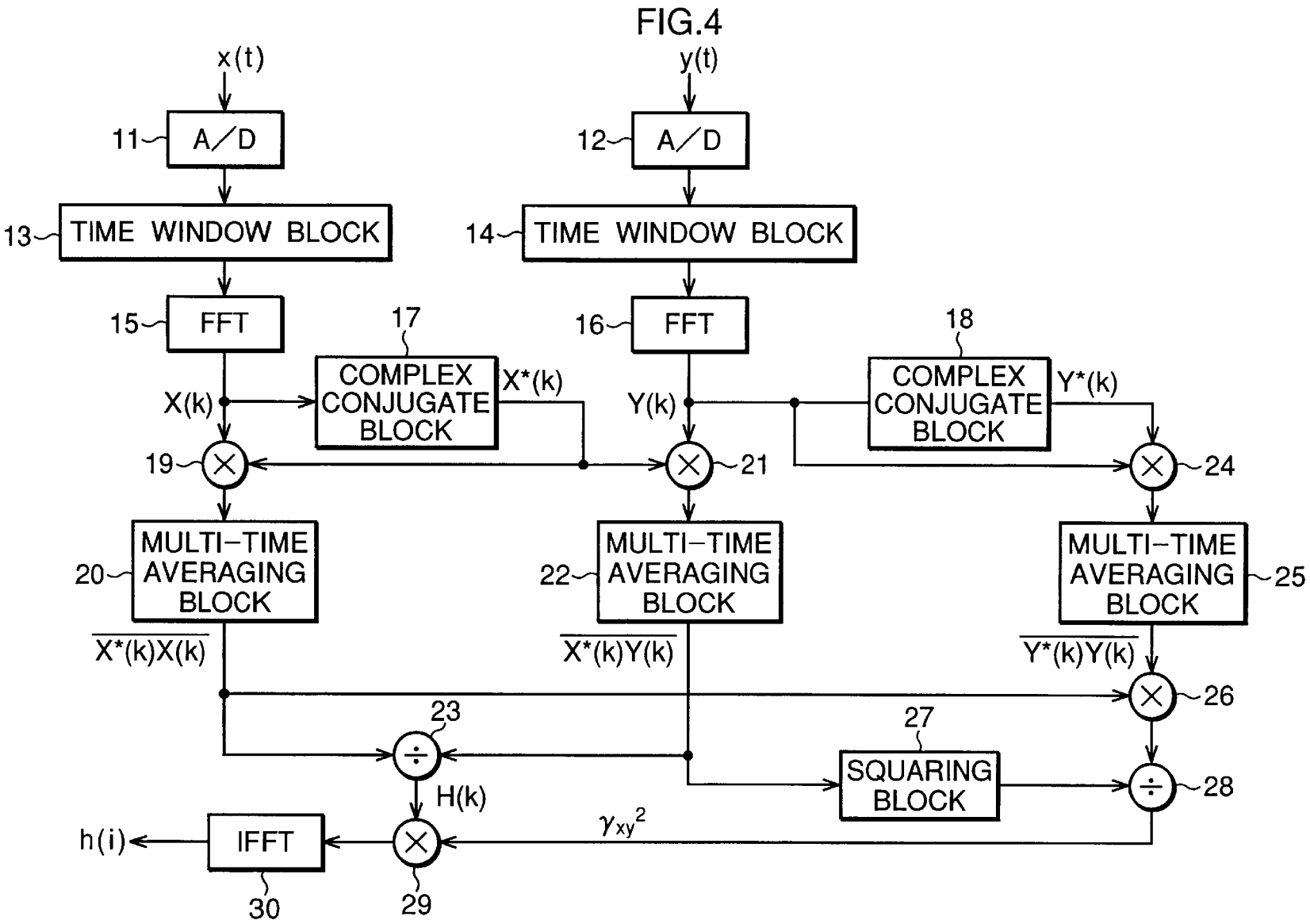
FIG. 4 is a functional block diagram illustrating a structual example of an impulse response measuring block of the preferred embodiment shown in FIG. 1.

FIG. 4 is a functional block diagram illustrating the impulse response measuring block 8 based on the cross-spectrum method described above. As shown, the input signal x(t) and the output signal y(t) are converted by A/D converters 11 and 12 into discrete series of values x(n) and y(n), respectively. These x(n) and y(n) are sampled in time window blocks 13 and 14, respectively, by a predetermined value with appropriate function windows. The results are transformed by FFT (Fast Fourier Transform) blocks 15 and 16 into spectrum X(k) and spectrum Y(k), respectively. Complex conjugate blocks 17 and 18 compute complex conjugate spectrum X*(k) and complex conjugate spectrum Y*(k), respectively. The spectrum X(k) and the spectrum X*(k) are multiplied with each other by a multiplier 19. The multiplication result is supplied to a multi-time averaging block 20 to provide a power spectrum. The spectrum X*(k) and the spectrum Y(k) are multiplied with each other by a multiplier 21. The multiplication result is supplied to a multi-time averaging block 22 to provide a cross spectrum. The power spectrum and the cross spectrum thus obtained are supplied to a divider 23 to provide the transfer function H(k).

On the other hand, the spectrum Y(k) and the spectrum Y*(k) are multiplied with each other by a multiplier 24. The multiplication result is supplied to a multi-time averaging block 25 to provide an output signal power spectrum. The power spectra of the input signal and the output signal are multiplied with each other by a multiplier 26. This multiplication result is supplied to a divider 28 along with a result obtained by squaring the cross spectrum by a squaring block 27. The coherence $\gamma xy_2$ is obtained by the divider 28. The obtained coherence $\gamma xy^2$ is multiplied by the transfer function H(k) by a multiplier 29. This multiplication result is supplied to an IFFT (Inverse Fast Fourier Transform) block 30 to provide the impulse response h(i).

The waveforms of the impulse response obtained as described above are shown in FIG. 3(*a*) and FIG. 3(*b*). In the impulse response waveform shown in FIG. 3(*a*), decay time T1 in which the amplitude drops from the maximum by 60 dB to below a predetermined level is shorter than a reference time T0. This consequently allows detection that no howl has taken place. In the impulse response waveform shown in FIG. 3(*b*), decay time T2 is longer than the reference time T0, so that occurrence of a howl can be detected.

Figure 5:
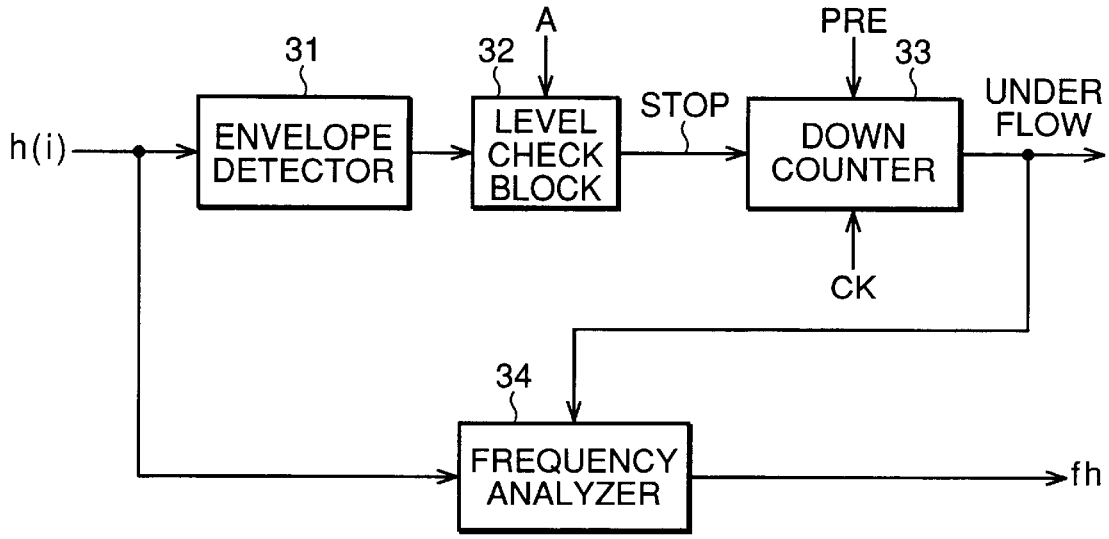
FIG. 5 is a functional block diagram illustrating an example of a howling detecting block in the preferred embodiment shown in FIG. 1.

FIG. 5 is a functional block diagram illustrating a specific example of the howling detecting block 9. The impulse response h(i) obtained by the impulse response measuring block 8 is inputted in an envelope detector 31 in synchronization with a predetermined clock signal CK for detection of an envelope of the impulse response waveform. A level check block 32 checks the envelope of the impulse response for a level drop from the maximum amplitude by a predetermined value (specified by coefficient A). A down counter 33 down-counts the clock signal CK when a preset value PRE is applied. When the level of the envelope of the impulse response drops by a predetermined value, the level check block 32 outputs a stop signal STOP to the down counter 33. If the down counter 33 underflows, the level check block 32 determines that a howl has taken place and outputs a signal indicating the occurrence of the howl. When the occurrence of the howl is detected, the frequency of the impulse response waveform is analyzed by a frequency analyzer 34, the detected peak frequency being outputted as a howling point fh.

The preset value PRE is equivalent to the reference time T0 shown in FIG. 3(*b*). This preset value PRE and the coefficient A may be appropriately set to proper values according to the environment in which the acoustic system is installed. Howling detection is performed at a certain period T repetitively as shown in FIG. 3(*c*). As the period T is shorter, so is a time from the occurrence of a howl to its cancellation. However, if the predetermined period T is too short, recognition of the occurrence of a howl is made difficult. Therefore, the predetermined period T may be set to several seconds by considering the acoustic system installation environment, the processing capacity of the hardware, and so on.

In the above-mentioned preferred embodiment, the impulse response h(i) is measured by the cross spectrum method. Practically, however, if the damping tendency of an impulse response waveform is predicted, it is enough for detecting a howl. Therefore, an impulse response need not be predicted so correctly. An impulse response can be obtained in a simpler method. The following describes this method, which is based on "A Method of Impulse Response Prediction by Only Multi-time Averaging" Kenichi Kido et al., Telecommunications Institute Research Report EA91-15 (1991).

As is evident from equation (1), an output signal y(n+j) can be expressed as equation (4) below:

$$y(n+j)=\sum_{i=0}^{N} x(n+j-i)h(i) \tag{4}$$
$$=(n+j)h(0)+x(n+j-1)h(1)+\cdots+x(n+j-i)h(i)+\cdots$$

When the output signal y(n+j) is multiplied by a sign sgn{x(n+j−i)} of an input signal x(n+j−i) which precedes the output signal by i, the result will be shown in equation (5) below:

$$sgn\{x(n+j-1)\}y(n+j)=C_0h(0)C_1h(1)+\ldots+C_1h(i)+ \tag{5}$$

where, when m≠i, $$C_m=sgn\{x(n+j-i)\}x(n+j-m)$$

when m=i, $$C_m=|x(n+j-i)|$$

Since the input signal x(n) presents an oscillating waveform around zero if it is an audio signal, additionally averaging equation (5) by varying the value of j converges coefficient $C_i$ of h(i) on the right side of equation (5) to a mean value of |x(n)|. In this case, coefficient $C_m$(m≠i) of h(m)(m≠i) is offset by plus and minus, decreasing its effect. Therefore, h(i) can be predicted as shown in equation (6) below:

$$h(i)=\frac{1}{|x(n)|}\frac{1}{N}\sum_{j=0}^{N} sgn\{x(n+j-i)\}y(n+j) \tag{6}$$

Since the purpose of this method is not to obtain an impulse response but to estimate or predict its damping characteristic, the dividing operation by |x(n)| of the denominator can be omitted.

In the above-mentioned simpler method, an impulse response waveform cannot be predicted correctly. However, this method generally provides an impulse response waveform having a high power spectrum and generally with a portion prone to howl emphasized, finding an extremely suitable application in howling detection.

Figure 6:
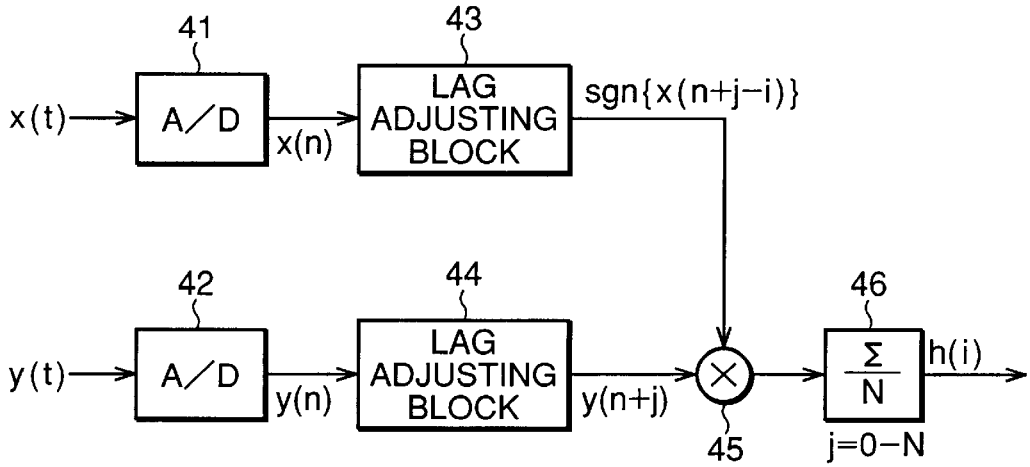
FIG. 6 is a functional block diagram illustrating another example of the impulse response measuring block in the preferred embodiment shown in FIG. 1.

FIG. 6 is a functional block diagram illustrating an example of the impulse response measuring block 8 based on this simpler method. An input signal x(t) and an output signal y(t) are converted by A/D converters 41 and 42, respectively. The converted signals are transformed into discrete series of signals x(n) and y(n), respectively. The x(n) is adjusted in lag by a lag adjusting block 43 to extract sgn{x(n+j−i)}. The y(n) is adjusted in lag by a lag adjusting block 44 to extract y(n+j). The sgn{x(n+j−1)} and the y(n+j) are multiplied with each other by a multiplier 45. The multiplication result is cumulatively added and its result is averaged until j=0 to N by a cumulative adding and averaging block 46, thereby providing the impulse response h(i).

According to the above-mentioned simplified embodiment, as compared with the complicated cross spectrum method, no processing need be performed in the frequency domain and therefore the impulse response can be obtained only by the simple dot product operation. Consequently, this embodiment simplifies the constitution of both hardware and software, thereby reducing the cost of the system.

As described above, the inventive howling detecting apparatus is provided in a sound system containing the microphone 1, the loudspeaker 2 and the amplifier 7 for detecting howling which may occur by feedback of sound from the loudspeaker 2 to the microphone 1. In the howling detecting apparatus, the measuring section 8 measures an impulse response h(t) of the sound system to determine a time length of a decay portion of the impulse response h(t). The detecting section 9 detects an occurrence of the howling when the determined time length is longer than a predetermined reference time length.

Preferably, the detecting section 9 analyzes a frequency spectrum of the decay portion of the impulse response h(t) to determine a frequency point fh at which the howling occurs. Preferably, the measuring section 8 measures the impulse response h(t) in situ based on the input signal x(t) to the amplifier 7 and the output signal y(t) from the amplifier 7 which is disposed between the microphone 1 and the loudspeaker 2 so as to determine the time length of the decay portion of the impulse response h(t) on real time. In such a case, the measuring section 8 measures the impulse response by time-sequentially computing a spectrum of the impulse response in terms of a ratio of a power spectrum of the input signal x(t) to a cross spectrum of the input signal x(t) and the output signal y(t). Otherwise, the measuring section 8 measures the impulse response by digitally processing the input signal x(t) and the output signal y(t) without computing spectra of the input signal and the output signal. Preferably, the measuring section 8 periodically measures an impulse response of the sound system at a predetermined time interval which is longer than the predetermined reference time length. Preferably, the measuring section 8 determines the time length of the decay portion of the impulse response h(t) in terms of a duration during which a decibel of the measured impulse response falls below a threshold decibel.

As described and according to the invention, an impulse response in an acoustic system is measured. If the time from starting the measurement of the impulse response to a predetermined damping level is longer than a predetermined time, or the tail of the impulse response becomes long, it is recognized that a howl has taken place. A howling point is detected from the frequency component of the waveform following the predetermined time of the impulse response, and the frequency component of this howling point is suppressed to cancel the howl. As compared with the conventional inverse signal adding method and the like, the novel method involves less chance of making a compensation error, less adversely affecting other frequency bands, thereby implementing effective howling cancellation.

While the preferred embodiments of the present invention have been described using specific terms, such description is for illustrative purposes only, and it is to be understood that changes and variations may be made without departing from the spirit or scope of the appended claims.

What is claimed is:

1. An apparatus provided in a sound system containing a microphone, a loudspeaker and an amplifier for detecting howling which may occur by feedback of sound from the loudspeaker to the microphone, the apparatus comprising:

a measuring section that measures an impulse response of the sound system to determine a time length of a decay portion of the impulse response; and a detecting section that detects an occurrence of the howling when the determined time length is longer than a predetermined reference time length.

2. An apparatus according to claim 1, wherein the detecting section analyzes a frequency spectrum of the decay portion of the impulse response to determine a frequency point at which the howling occurs.

3. An apparatus according to claim 1, wherein the measuring section measures the impulse response in situ based on an input to and an output from the amplifier which is disposed between the microphone and the loudspeaker so as to determine the time length of the decay portion of the impulse response on real time.

4. An apparatus according to claim 3, wherein the measuring section measures the impulse response by time-sequentially computing a spectrum of the impulse response in terms of a ratio of a power spectrum of the input to a cross spectrum of the input and the output.

5. An apparatus according to claim 3, wherein the measuring section measures the impulse response by digitally processing the input and the output without computing spectra of the input and the output.

6. An apparatus according to claim 1, wherein the measuring section periodically measures an impulse response of the sound system at a predetermined time interval which is longer than the predetermined reference time length.

7. An apparatus according to claim 1, wherein the measuring section determines the time length of the decay portion of the impulse response in terms of a duration during which a decibel of the measured impulse response falls below a threshold decibel.

8. An apparatus provided in a sound system containing a microphone, a loudspeaker and an amplifier for canceling howling which may occur by feedback of sound from the loudspeaker to the microphone, the apparatus comprising:

a measuring section that measures an impulse response of the sound system to determine a time length of a decay portion of the impulse response;

a detecting section that detects an occurrence of the howling when the determined time length is longer than a predetermined reference time length, and that further analyzes a frequency spectrum of the decay portion of the impulse response to determine a frequency point at which the howling occurs; and an attenuating section that attenuates a frequency component of the sound around the determined frequency point so as to cancel the howling.

9. An apparatus according to claim 8, wherein the measuring section measures the impulse response in situ based on an input to and an output from the amplifier which is disposed between the microphone and the loudspeaker so as to determine the time length of the decay portion of the impulse response on real time.

10. An apparatus according to claim 8, wherein the measuring section periodically measures an impulse response of the sound system at a predetermined time interval which is longer than the predetermined reference time length.

11. An apparatus according to claim 8, wherein the measuring section determines the time length of the decay portion of the impulse response in terms of a duration during which a decibel of the measured impulse response falls below a threshold decibel.

12. An apparatus according to claim 8, wherein the attenuating section comprises an equalizer connected to the amplifier for variably attenuating a frequency component of the sound in response to the determined frequency point.

13. A method of detecting howling which may occur by feedback of sound from a loudspeaker to a microphone in a sound system containing an amplifier disposed between the microphone and the loudspeaker, the method comprising the steps of:

measuring an impulse response of the sound system to determine a time length of a decay portion of the impulse response; and detecting an occurrence of the howling when the determined time length is longer than a predetermined reference time length.

14. A method according to claim 13, wherein the step of measuring measures the impulse response in situ based on an input to and an output from the amplifier so as to determine the time length of the decay portion of the impulse response on real time.

15. A method of canceling howling which may occur by feedback of sound from a loudspeaker to a microphone in a sound system containing an amplifier disposed between the microphone and the loudspeaker, the method comprising the steps of:

measuring an impulse response of the sound system to determine a time length of a decay portion of the impulse response;

detecting an occurrence of the howling when the determined time length is longer than a predetermined reference time length;

analyzing a frequency spectrum of the decay portion of the impulse response to determine a frequency point at which the howling occurs; and attenuating a frequency component of the sound around the determined frequency point so as to cancel the howling.

16. A method according to claim 15, wherein the step of measuring measures the impulse response in situ based on an input to and an output from the amplifier so as to determine the time length of the decay portion of the impulse response on real time.

* * * * *